US006098444A

United States Patent [19]

Wu

[11] Patent Number: 6,098,444

[45] Date of Patent: Aug. 8, 2000

[54] WIRE OUTPUT CENTRAL SHAFT OF A WIRE BENDING MACHINE

[76] Inventor: David Wu, No. 21, Alley 9, Lane 27, Sec. 5, Min Sheng E. Rd., Taipei, Taiwan

[21] Appl. No.: 09/360,080

[22] Filed: Jul. 22, 1999

[51] Int. Cl.[7] ..... B21D 43/16

[52] U.S. Cl. ..... 72/428; 72/140; 72/142

[58] Field of Search ..... 72/135, 140, 142, 72/428; 242/397, 548, 566, 615, 615.3, 157 R; 226/196.1

[56] References Cited

U.S. PATENT DOCUMENTS

| | | | |
|---|---|---|---|
| 5,791,184 | 8/1998 | Wu | 72/140 |
| 5,839,312 | 11/1998 | Itaya | 72/135 |
| 5,887,471 | 3/1999 | Itaya | 72/142 |

*Primary Examiner*—Ed Tolan

*Attorney, Agent, or Firm*—Rosenberg, Klein & Lee

[57] ABSTRACT

A wire output central shaft of a wire bending machine comprises a seat, two wire plates, an central shaft seat, and a central shaft. The seat has a body, and one end of the body is connected to the body. A through hole is installed on the fixing portion. A first concave chamber and the second concave chamber are installed on the body. The first concave chamber is behind the second concave chamber. Two wire plates each is installed with a wire groove. As the two wire plate are combined to be located against one another, the two wire grooves will be combined. The two wire plates are fixed to the first concave chamber of the seat. The central shaft is installed on and penetrating through the central shaft seat. A wire hole is installed on the central shaft and extends along the length of the central shaft seat. The central shaft seat is assembled to the second concave chamber of the seat and is locked to the seat. The wire hole of the central shaft is in a position with respect to the through hole of the seat. Thereby, a wire output central shaft with a lower cost, easily updating and maintaining structure is formed.

8 Claims, 4 Drawing Sheets

WIRE OUTPUT CENTRAL SHAFT OF A WIRE BENDING MACHINE

BACKGROUND OF THE INVENTION

1. Field of the Invention

The present invention relates to a wire output central shaft of a wire bending machine, and especially to a wire output central shaft structure installed on a wire bending machine for guiding a wire.

2. Description of the Prior Art

A prior art wire bending machine is a device for bending a wire for forming with a spring and other elements. As shown in FIG. 1, the wire output central shaft structure of a prior art wire bending machine includes a seat 10*a* at one end which is connected to a fixing portion 11*a*. The fixing portion 11*a* can be fixed to a wire bending machine by locking elements, such as screws. A central shaft 12*a* is firmly secured to the seat 10*a*. The central shaft 12*a* is installed along the length direction of the seat 10*a*. A wire hole 13*a* is installed on the central shaft 12*a*. A transferring path for a wire can be formed by the wire hole 13*a* of the central shaft 12*a* for guiding a wire to be output so that the wire can be transferred to a wire bending machine.

However, the prior art central shaft 12*a* is made of tungsten and other material high speed steel which is very expensive. Moreover, the central shaft 12*a* penetrates through the whole length of the seat. Therefore, many materials are wasted. Moreover, the central shaft 12*a* is firmly installed at the seat 10*a*. Therefore, if the central shaft 12*a* is worn or destroyed. The whole wire output central shaft must be updated.

SUMMARY OF THE INVENTION

Accordingly, the object of the present invention is to provide a wire output central shaft of a wire bending machine comprises a seat, two wire plates, an central shaft seat, and a central shaft. The seat has a body, and one end of the body is connected to the body. A through hole is installed on the fixing portion. A first concave chamber and the second concave chamber are installed on the body. The first concave chamber is behind the second concave chamber. Two wire plates each is installed with a wire groove. As the two wire plates are combined to be located against one another, the two wire grooves will be combined. The two wire plates are fixed to the first concave chamber of the seat. The central shaft is installed on and penetrating through the central shaft seat. A wire hole is installed on the central shaft and extends along the length of the central shaft seat. The central shaft seat is assembled to the second concave chamber of the seat and is locked to the seat. The wire hole of the central shaft is in a position with respect to the through hole of the seat. Thereby, a wire output central shaft with a lower cost, easily updating and maintaining structure is formed.

The present invention will be better understood and its numerous objects and advantages will become apparent to those skilled in the art by referencing to the following drawings in which:

DETAILED DESCRIPTION OF THE PREFERRED EMBODIMENT

Figure 1:
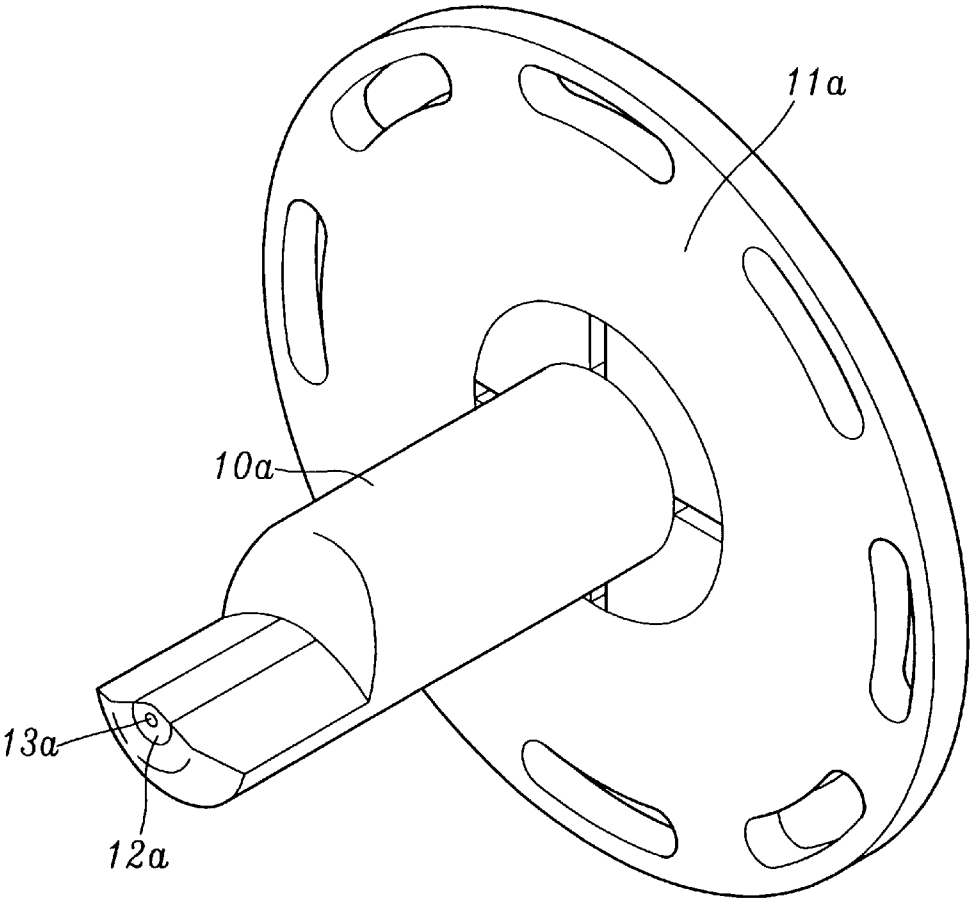
FIG.1 PRIOR ART
FIG. 1 is a perspective view of a prior art wire output axial center of a wire bending machine.
Figure 2:
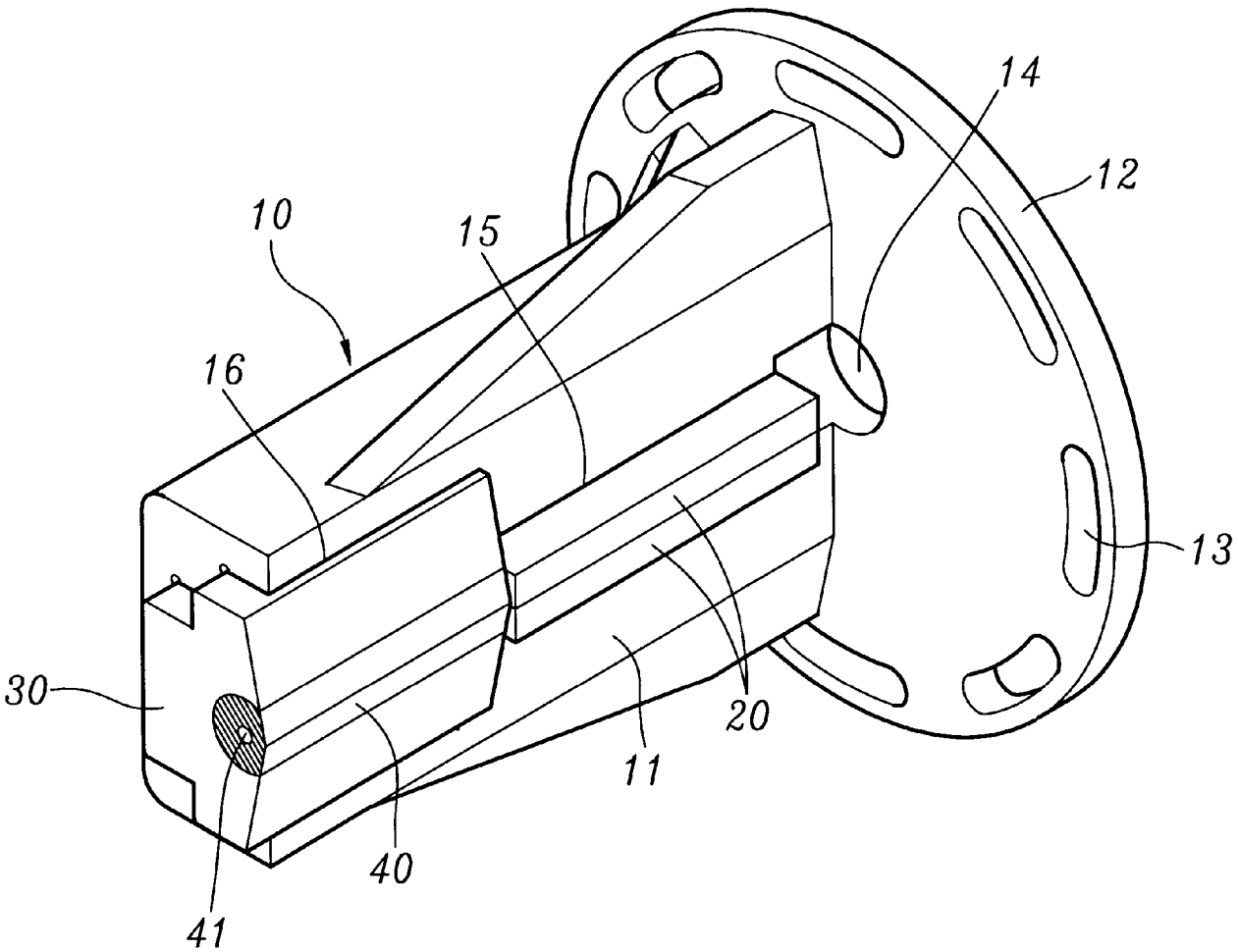
FIG. 2 is a perspective view of the present invention.
Figure 3:
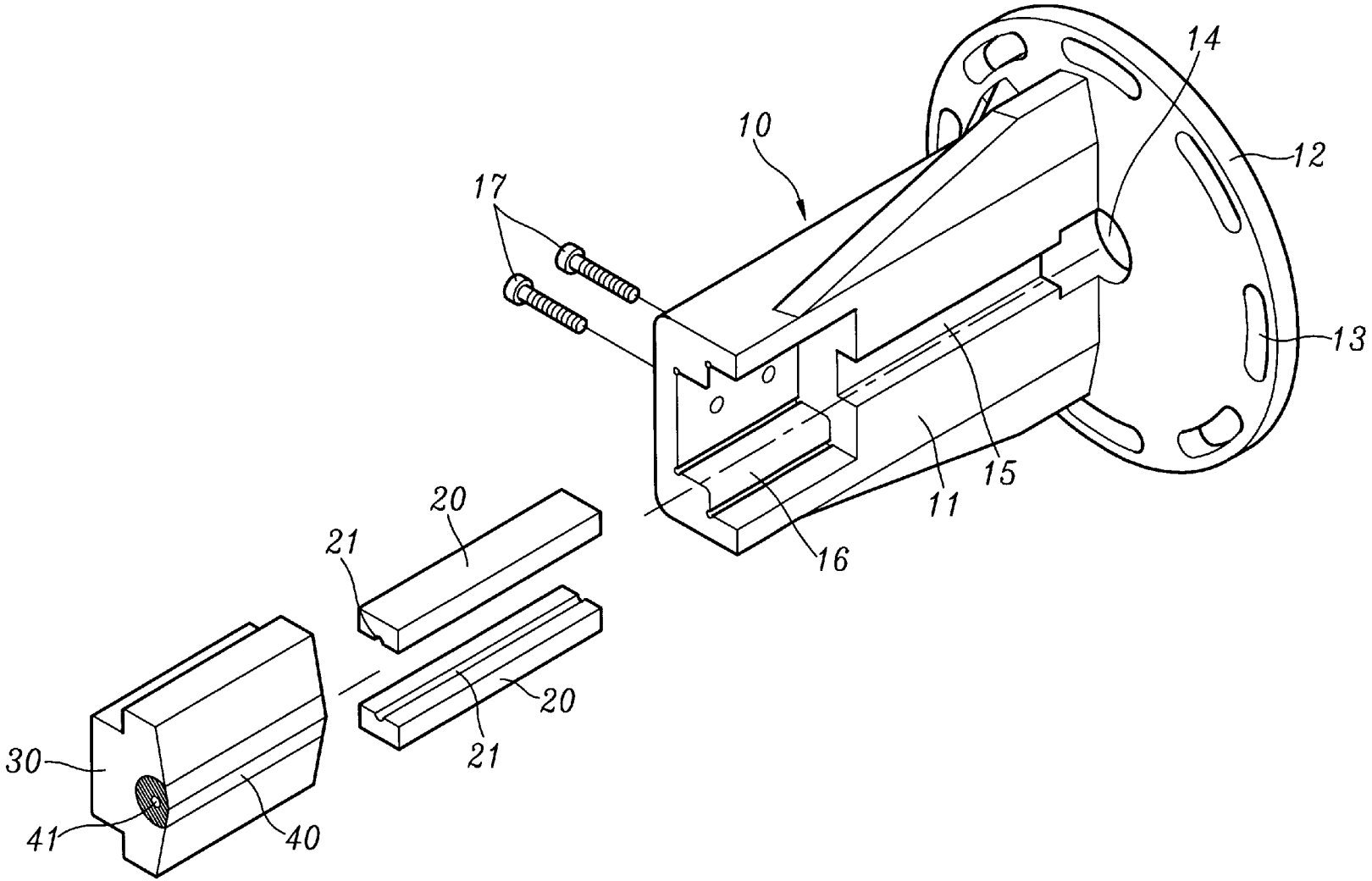
FIG. 3 is an exploded perspective view of the present invention.
Figure 5:
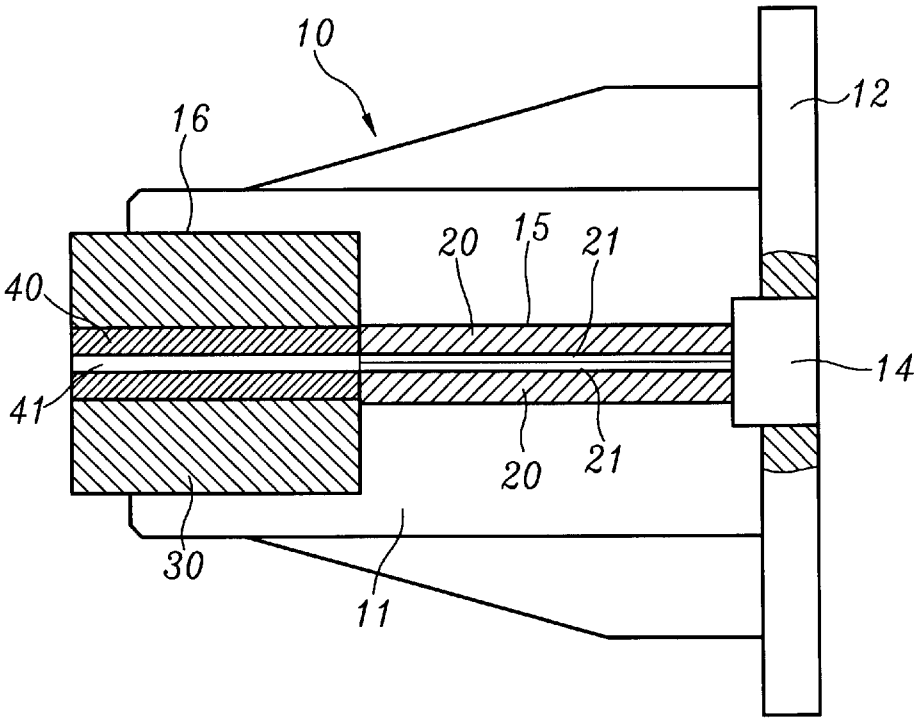
FIG. 5 is a lateral cross sectional view of the present invention.
Figure 4:
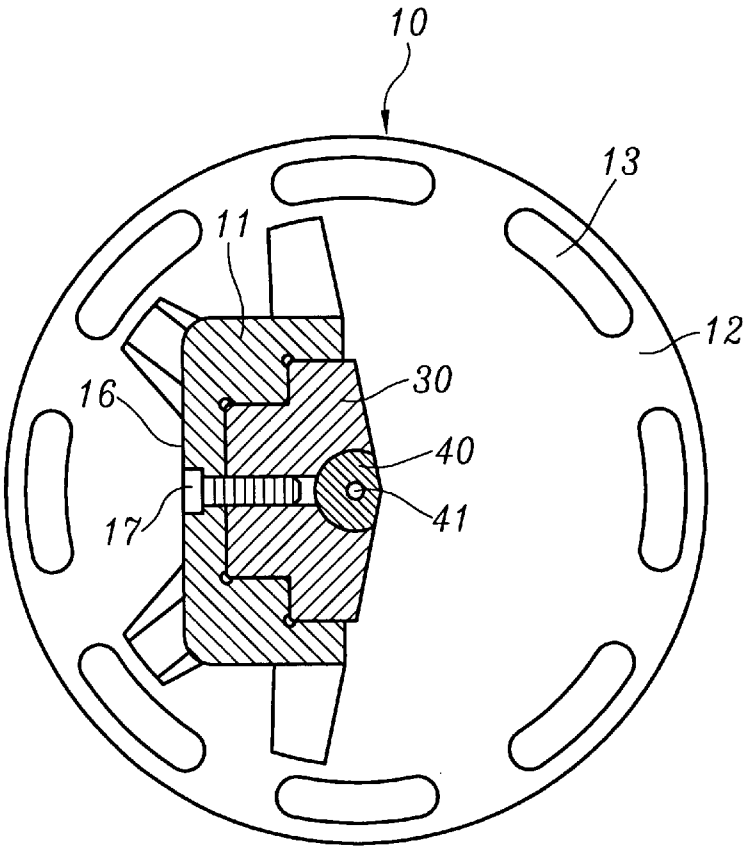
FIG. 4 is a front cross sectional view of the present invention.

With reference to FIGS. 2, 3, 4, and 5, the present invention provides a wire output central shaft of a wire bending machine, wherein the wire output central shaft is installed at a general wire bending machine (not shown) for guiding the output of a wire to a wire bending machine. Thus, the wire can be bent to form with a desired shape, such as spring and other components. The wire output central shaft includes a seat 10, two wire plates 20, a central shaft seat 30 and an central shaft 40. The seat 10 has a body 11. One end of the body 11 is connected to a fixing portion 12 having a round shape. A plurality of fixing holes 13 are installed on the fixing portion 12. Locking elements (not shown), such as screws, may be inserted through the fixing holes 13 for fixing the fixing portion 12 to the wire bending machine. A through hole is installed at the center of the fixing portion 14. A first concave chamber 15 and a second concave chamber 16 are installed at the body 11. The first concave chamber 15 is behind the second concave chamber 16. The first concave chamber 15 and the second concave chamber 16 are at positions with respect to the through hole 14. The first concave chamber 15 is a long slot and the second concave chamber 16 is an approximately T shape groove.

Two wire plates 20 are opposite long plates, and the adjacent surfaces of the plates 20 are installed with wire grooves 21 which are a semicircular cross section. The two wire grooves can be combined as a circular as they are located against with one another. Then, the two wire plates 20 are embedded into the first concave chamber 15 of the seat 10.

The central shaft seat 30 is an approximate T shape block. The central shaft 40 is fixed installed at the central shaft scat 30. The central shaft 30 extends along the length of the central shaft seat 30 and then passes through the whole central shaft seat 30. The central shaft 40 is made of tungsten steel and other high speed steel. A round wire hole 41 extending along the length of the central shaft is firmly secured to the central shaft 40. The central shaft seat 30 is assembled to the second concave chamber 16 of the seat 10. By two screws 17, the central shaft seat 30 is locked to the seat 10. The wire hole 41 of the central shaft 40 is at a position with respect to the through hole 14 of the seat 10 and the wire grooves of the wire plates 20. Thereby, a wire output central shaft is formed.

In the present invention, a transferring line is formed by the through hole 14 of the seat 10, the wire grooves 21 of the wire plates 20, and the wire hole 41 of the central shaft 40 for guiding the output of wire. Thus, wire can be transferred to a wire bending machine.

In the present invention, the central shaft seat 30 and the central shaft 40 are assembled to the seat 10. They only need to be installed in front of the seat 10. Thus, the length of the central shaft 40 can be reduced greatly. Therefore, the cost of material is reduced. The central shaft seat 30 and central shaft 40 are assembled to the seat 10. If the central shaft 40 is worn or destroyed, it is only needed to update the central shaft seat 30 or central shaft 40 without needing to update the whole structure of the wire output central shaft.

Although the present invention has been described using specified embodiment, the examples are meant to be illustrative and not restrictive. It is clear that many other variations would be possible without departing from the basic approach, demonstrated in the present invention.

What is claimed is:

1. A wire output shaft assembly for a wire bending machine comprising:

(a) a seat including:

(1) a fixing portion having a through hole passing axially therethrough;

(2) a body portion extending from said fixing portion, said body portion having formed therein axially offset first and second chambers in open communication one with the other;

(b) a pair of opposed wire plate members coupled to said seat, said wire plate members being received in said first open chamber to define therebetween a wire passage substantially aligned axially with said through hole of said fixing portion, said wire plate members being axially offset from said fixing portion;

(c) an integrally formed central shaft seat member coupled to said seat, said central shaft seat member being received in said second open chamber; and, (d) a central shaft member captively disposed in said central shaft seat member, said central shaft member having formed therethrough a wire hole substantially aligned axially with said through hole of said fixing portion.

2. The wire output shaft assembly as recited in claim 1 wherein said fixing portion has formed therethrough a plurality of fixing holes, said fixing holes being angularly displaced one from the other about said through opening.

3. The wire output shaft assembly as recited in claim 1 wherein at least a portion of said second open chamber defines a substantially T-shaped sectional contour.

4. The wire output shaft assembly as recited in claim 3 wherein said first open chamber is formed as an axially extended slot.

5. The wire output shaft assembly as recited in claim 1 wherein said wire hole of said central shaft member defines a substantially circular sectional contour.

6. The wire output shaft assembly as recited in claim 1 wherein each said wire plate member has formed therein an axially extended wire groove, said wire grooves of said wire plate pair cooperatively defining said wire passage.

7. The wire output shaft assembly as recited in claim 6 wherein said wire passage defines a substantially circular sectional contour.

8. The wire output shaft assembly as recited in claim 7 wherein each said wire groove defines a substantially semicircular sectional contour.

* * * * *